US009410779B1

(12) United States Patent
Ginetto et al.

(10) Patent No.: US 9,410,779 B1
(45) Date of Patent: Aug. 9, 2016

(54) BREAKAWAY FIN RING FOR PROJECTILE

(71) Applicants: Stephen Ginetto, Carlstadt, NJ (US); Andrew Moramarco, Staten Island, NY (US); Leanne Mohla, Blairstown, NJ (US)

(72) Inventors: Stephen Ginetto, Carlstadt, NJ (US); Andrew Moramarco, Staten Island, NY (US); Leanne Mohla, Blairstown, NJ (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 135 days.

(21) Appl. No.: 14/496,008

(22) Filed: Sep. 25, 2014

(51) Int. Cl.
*F42B 10/14* (2006.01)
*F42B 14/06* (2006.01)

(52) U.S. Cl.
CPC ..... *F42B 10/14* (2013.01)

(58) Field of Classification Search
CPC ..... F42B 10/14; F42B 10/143; F42B 14/06; F42B 14/061; F42B 14/062; F42B 14/064
See application file for complete search history.

(56) References Cited

U.S. PATENT DOCUMENTS

| | | | | |
|---|---|---|---|---|
| 2,597,703 | A * | 5/1952 | Busacker | F42B 10/06 102/348 |
| 6,869,044 | B2 * | 3/2005 | Geswender | F42B 10/06 244/3.1 |
| 7,800,032 | B1 * | 9/2010 | Facciano | F42B 10/64 244/3.24 |
| 7,829,829 | B2 * | 11/2010 | King | F42B 10/143 244/3.24 |
| 8,294,072 | B2 * | 10/2012 | Geswender | F42B 10/16 244/3.24 |
| 2008/0006736 | A1 * | 1/2008 | Banks | F42B 10/64 244/3.21 |

* cited by examiner

*Primary Examiner* — Christopher P Ellis
*Assistant Examiner* — Michael Wang
(74) *Attorney, Agent, or Firm* — Michael C. Sachs

(57) ABSTRACT

A frangible fin ring for a low velocity, gun-launched projectile includes a circular base with a plurality of trunnions extending radially outward from the circular base. Fins are mounted to the trunnions. A line of frangibility between adjacent trunnions includes a rear notch, a circular opening and a front notch, preferably all axially aligned. Upon impact of the projectile with a target, the fin ring breaks apart at the lines of frangibility and separates from the projectile.

20 Claims, 3 Drawing Sheets

BREAKAWAY FIN RING FOR PROJECTILE

STATEMENT OF GOVERNMENT INTEREST

The inventions described herein may be manufactured, used and licensed by or for the United States Government.

BACKGROUND OF THE INVENTION

The invention relates in general to gun-launched projectiles and in particular to stabilizing fins for gun-launched projectiles.

Some gun-launched projectiles are stabilized in flight by fins. Fins come in many designs. In some designs, a fin ring is attached to the projectile body and the fins are attached to the fin ring with pins and springs. Known fin rings survive gun launch, projectile flight and projectile impact with a target.

Projectiles must have large amounts of kinetic energy to penetrate targets such as triple brick walls and double reinforced concrete. The fin rings and fins on a projectile consume a portion of the available target-penetrating kinetic energy in the process of breaking the fin ring and/or fins during target penetration by the projectile. The fin ring may also have a step up in diameter compared to the warhead body, which impedes penetration. In addition, the fins that are attached to the fin ring may have a hooking effect when they contact the target surface. Projectiles with a relatively low velocity, such as those fired from multi-target shoulder fired weapons, have less kinetic energy than higher velocity projectiles. The consumption of kinetic energy by the fin ring and fins on a low kinetic energy projectile can inhibit the complete penetration of a target.

A need exists for a fin ring that survives gun tube launch and projectile flight but fails upon target impact to enable a low velocity projectile to penetrate a target with less resistance.

SUMMARY OF INVENTION

One aspect of the invention is a fin ring for a gun-launched projectile. The fin ring includes a circular base centered on a central longitudinal axis of the fin ring. A plurality of trunnions are equally circumferentially spaced around the circular base. Each trunnion extends radially outward from the circular base and includes fin mounting holes therein. A plurality of axially extending rear notches are formed in the circular base. The rear notches begin at a rear perimeter of the circular base and extend axially forward. A plurality of axially extending front notches are formed in the circular base. The front notches begin at a front perimeter of the circular base and extend axially rearward. A plurality of circular openings are formed in the circular base.

The fin ring may include a plurality of fins. Each fin may be mounted to a respective one of the plurality of trunnions.

The plurality of rear notches may be circumferentially equally spaced around the circular base. The plurality of front notches may be circumferentially equally spaced around the circular base. The plurality of circular openings may be circumferentially equally spaced around the circular base.

Each rear notch may be axially aligned with a front notch. One of the plurality of circular openings may be disposed between each rear notch and front notch. The plurality of rear notches may be circumferentially equally spaced between the plurality of trunnions.

Another aspect of the invention is a projectile having a novel fin ring.

In another aspect, the invention includes a method. The method includes launching a projectile having a novel fin ring. Upon impact of the projectile with a target, the fin ring is broken into a plurality of pieces.

The invention will be better understood, and further objects, features and advantages of the invention will become more apparent from the following description, taken in conjunction with the accompanying drawings.

BRIEF DESCRIPTION OF THE DRAWINGS

In the drawings, which are not necessarily to scale, like or corresponding parts are denoted by like or corresponding reference numerals.

DETAILED DESCRIPTION

A novel fin ring with fins is fixed to a projectile. When the projectile impacts a target, the fin ring breaks up. When the fin rings breaks up, it snaps off the projectile body and eliminates the stepped up diameter transition that hampers penetration of the projectile into the target. Further, the grappling hook effect of the fins is eliminated because the fins are discarded when the fin ring breaks off the projectile.

Figure 1:
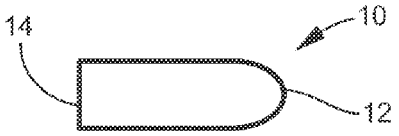
FIG. 1 PRIOR ART
FIG. 1 is a schematic of a projectile.
Figure 2:
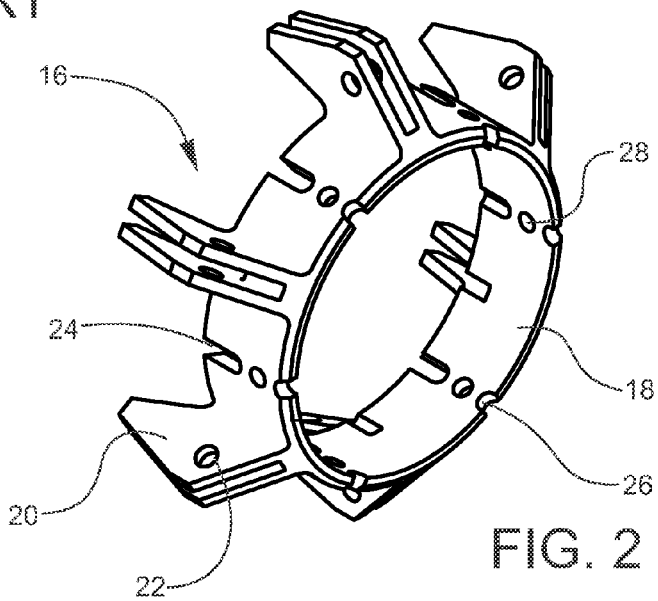
FIG. 2 is a perspective view of one embodiment of a fin ring.
Figure 3:
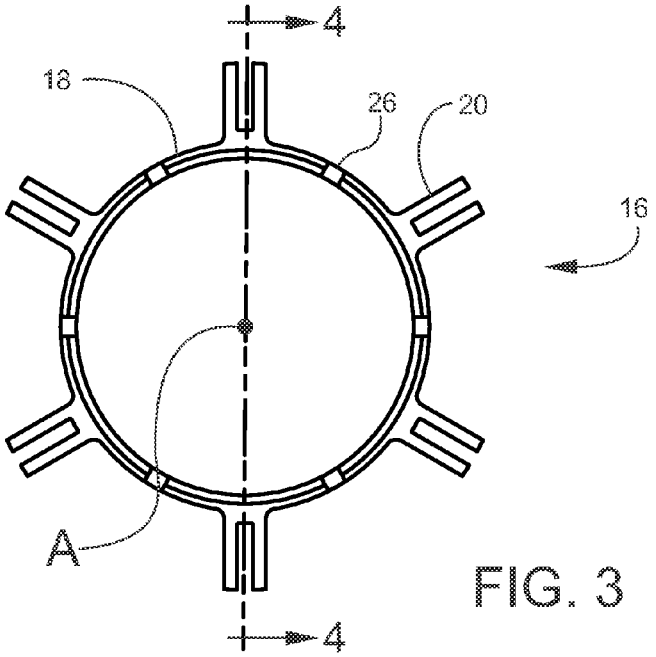
FIG. 3 is a front end view of the fin ring of FIG. 2.
Figure 4:
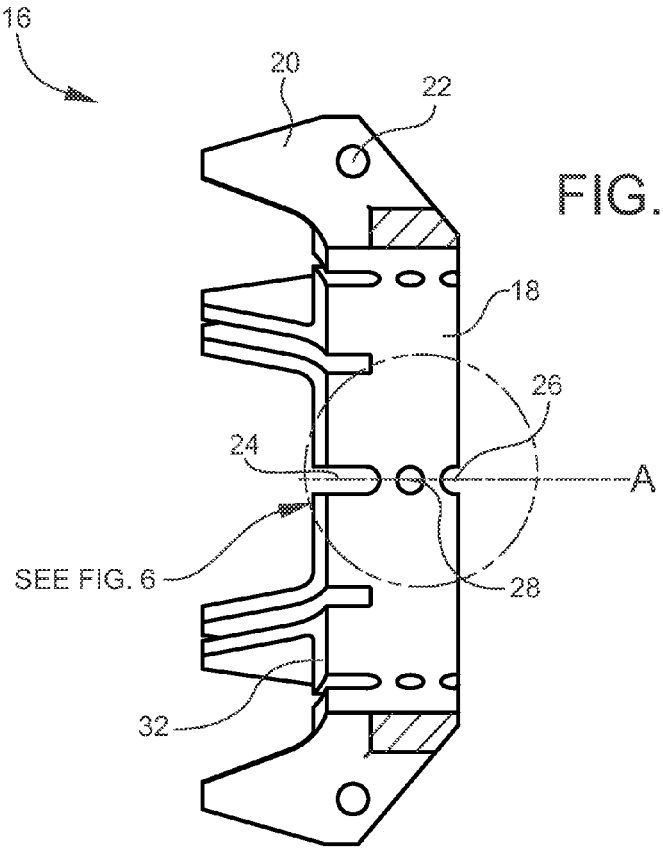
FIG. 4 is a sectional view taken along the line 4-4 of FIG. 3.
Figure 5:
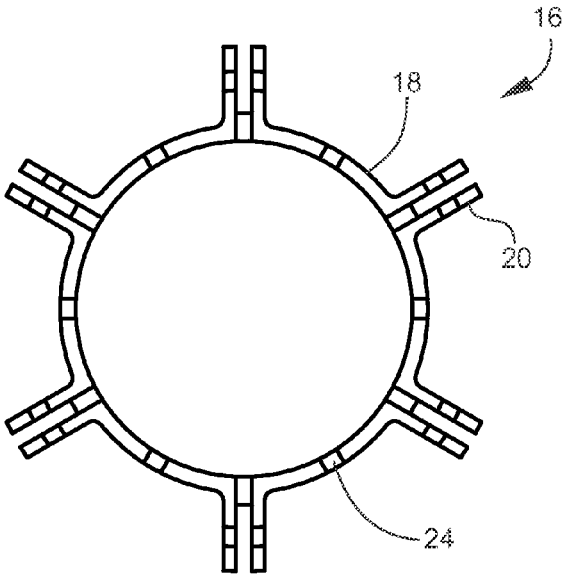
FIG. 5 is a rear end view of the fin ring of FIG. 2.
Figure 6:
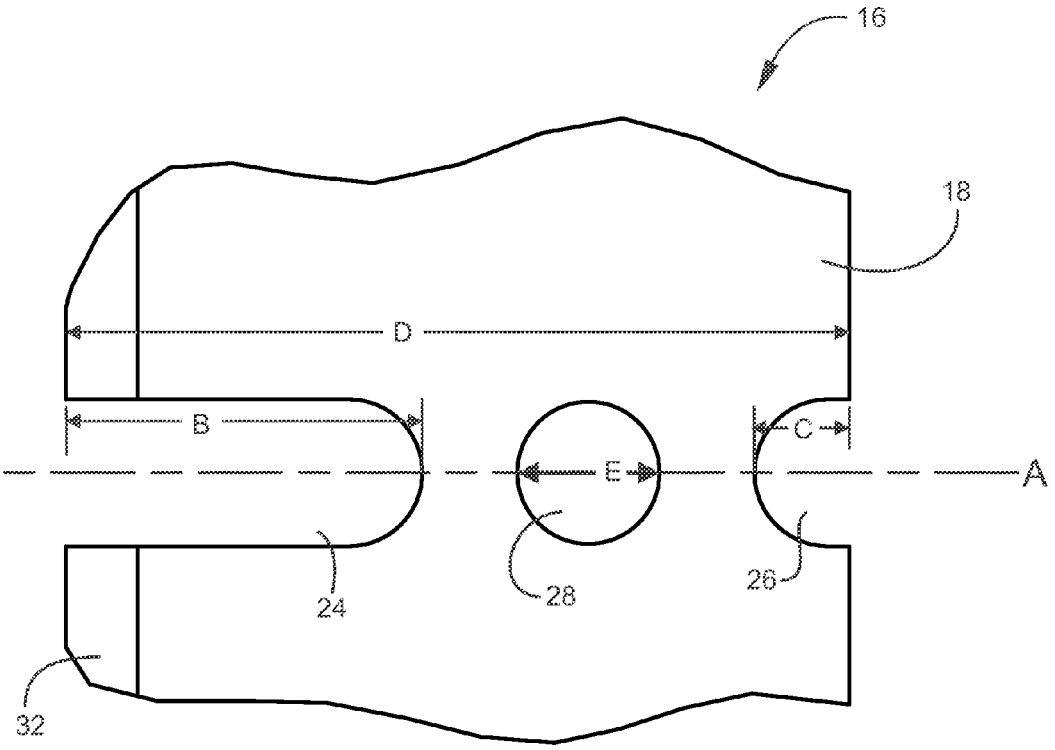
FIG. 6 is an enlarged view of a portion of FIG. 4.
Figure 7:
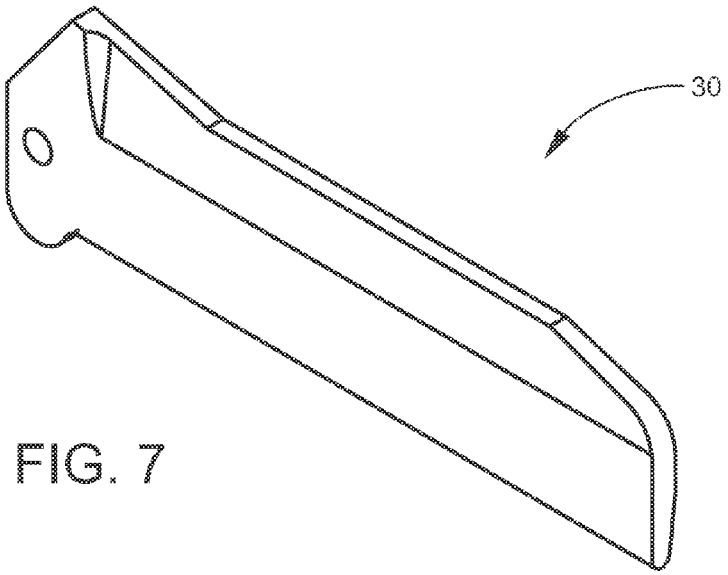
FIG. 7 is a perspective view of a fin.

FIG. 1 is a schematic of a gun-launched projectile 10 having a front end 12 and a rear end 14. A fin ring having deployable fins may be fixed to the rear end 14 of projectile 10 to stabilize its flight. The caliber of projectile 10 may vary, for example, from about 40 mm to 100 mm or larger. When fitted with the novel fin ring disclosed herein, projectile 10 may be launched from a variety of gun tubes and weapons. For example, projectile 10 may be launched from a single use, shoulder-fired munition. The novel fin ring is advantageous for use with low velocity projectiles because the fin ring will break apart upon impact of its carrier projectile with a target. The breaking apart of the fin ring eliminates the loss of kinetic energy associated with interaction of the fin ring and fins with the target.

FIGS. 2-7 show one embodiment of a fin ring 16 for a gun-launched projectile. Ring 16 may be made of, for example, an aluminum alloy. Ring 16 has a central longitudinal axis A and a circular base 18 centered on axis A. A plurality of trunnions 20 are equally circumferentially spaced around the circular base 18. Each trunnion 20 extends radially outward from the circular base 18 and includes fin mounting holes 22 therein. A fin 30 (FIG. 7) is mounted to each trunnion 20. The number of fins 30 may vary, with an odd number of fins preferred.

A plurality of axially extending rear notches 24 are formed in the circular base 18. The rear notches 24 begin at a rear perimeter of the circular base 18 and extend axially forward. A plurality of axially extending front notches 26 are formed in the circular base 18. The front notches 26 begin at a front perimeter of the circular base 18 and extending axially rearward. A plurality of circular openings 28 are also formed in the circular base 18. The rear perimeter of the circular base 18 may include a chamfer 32.

The plurality of rear notches 24 may be circumferentially equally spaced around the circular base 18. The plurality of front notches 26 may be circumferentially equally spaced around the circular base 18. The plurality of circular openings 28 may be circumferentially equally spaced around the circular base 18. Each rear notch 24 may be axially aligned with a front notch 26. Each of the plurality of circular openings 28 may be disposed between a rear notch 24 and a front notch 26. Preferably, the number of rear notches 24, the number of front notches 26 and the number of openings 28 equal the number of trunnions 20 or fins 30. The rear notches 24 may be circumferentially equally spaced between the plurality of trunnions 20.

In one embodiment, the axial length B (FIG. 6) of each rear notch 24 is more than twice the axial length C of each front notch 26. In some embodiments, the combined axial length (B plus C plus E) of a rear notch 24 a circular opening 28 and a front notch 26 is more than one half of the axial width D of the circular base 18.

To mount fin ring 16 to the rear of projectile 10, pins (not shown) may be inserted through circular openings 28 in base 18 and press fit into openings (not shown) in projectile 10. In addition to being part of the mounting assembly, openings 28 function as stress risers that facilitate the breakup of ring 16 along the longitudinal axis of aligned notches 24, 26.

Upon impact of projectile 10 with a target, notches 24, 26 create a moment in the target impact direction. The larger rear notch 24 allows more deformation of material. The moment of inertia of the trunnion 20, fin 30 and fin mounting spring (not shown) creates forces to break the ring 16. The fin ring 16 conserves kinetic energy because the impact of fins 30 is not used the break the fin ring 16. In addition, breakup of the fin ring 16 removes the stepped up diameter of the fin ring, which results in a smoother, more continuous projectile surface for target penetration. The fin ring 16 remains robust and structurally sound during gun launch and fin opening.

During testing, the fin ring 16 was intact after gun launch and remained together during fin deployment and projectile flight. After target impact, fin ring 16 broke into a plurality of pieces at respective aligned pairs of notches 24, 26.

While the invention has been described with reference to certain embodiments, numerous changes, alterations and modifications to the described embodiments are possible without departing from the spirit and scope of the invention as defined in the appended claims, and equivalents thereof

What is claimed is:

1. A fin ring for a gun-launched projectile, comprising:

a circular base centered on a central longitudinal axis of the fin ring;

a plurality of trunnions equally circumferentially spaced around the circular base, each trunnion extending radially outward from the circular base and including fin mounting holes therein;

a plurality of axially extending rear notches formed in the circular base, the rear notches beginning at a rear perimeter of the circular base and extending axially forward;

a plurality of axially extending front notches formed in the circular base, the front notches beginning at a front perimeter of the circular base and extending axially rearward; and a plurality of circular openings formed in the circular base.

2. The tin ring of claim 1, further comprising a plurality of fins, each fin being mounted to a respective one of the plurality of trunnions.

3. A projectile comprising the fin ring of claim 2.

4. The fin ring of claim 1, wherein the ring is made of an aluminum alloy.

5. The fin ring of claim 1, wherein the plurality of rear notches are circumferentially equally spaced around the circular base.

6. The fin ring of claim 5, wherein the plurality of front notches are circumferentially equally spaced around the circular base.

7. The fin ring of claim 6, wherein the plurality of circular openings are circumferentially equally spaced around the circular base.

8. The fin ring of claim 7, wherein each rear notch is axially aligned with a front notch.

9. The fin ring of claim 8, wherein an axial length of each rear notch is more than twice an axial length of each front notch.

10. The fin ring of claim 9, wherein a combined axial length of one of the rear notches, one of the circular openings and one of the front notches is more than one half of an axial width of the circular base.

11. The fin ring of claim 10, wherein the rear perimeter of the circular base includes a chamfer.

12. The fin ring of claim 8, wherein one of the plurality of circular openings is disposed between each rear notch and front notch.

13. The fin ring of claim 12, wherein a number of trunnions equals a number of rear notches.

14. The fin ring of claim 13, wherein the plurality of rear notches are circumferentially equally spaced between the plurality of trunnions.

15. A method, comprising:

launching a projectile having the fin ring of claim 12;

upon impact of the projectile with a target, breaking the fin ring into a plurality of pieces.

16. The method of claim 15, wherein breaking includes breaking the fin ring at a location having an axially aligned rear notch, circular opening and front notch.

17. The method of claim 15, wherein a number of the plurality of pieces equals a number of the plurality of rear notches.

18. A fin ring for a gun-launched projectile, comprising:

a circular base centered on a central longitudinal axis of the fin ring;

a plurality of trunnions equally circumferentially spaced around the circular base, each trunnion extending radially outward from the circular base and including fin mounting holes therein;

a plurality of axially extending rear notches formed in the circular base, the rear notches beginning at a rear perimeter of the circular base and extending axially forward, the rear notches being circumferentially equally spaced around the plurality of trunnions;

a plurality of axially extending front notches formed in the circular base, the front notches beginning at a front perimeter of the circular base and extending axially rearward and being axially aligned with respective ones of the plurality of rear notches; and a plurality of circular openings formed in the circular base, the plurality of circular openings being disposed between and axially aligned with respective ones of the plurality front notches and the plurality of rear notches; and a plurality of fins, each fin being mounted to a respective one of the plurality of trunnions wherein a number of fins equals a number of rear notches.

19. The fin ring of claim 18, wherein an axial length of each rear notch is more than twice an axial length of each front notch.

20. The fin ring of claim 19, wherein a combined axial length of one of the rear notches, one of the circular openings and one of the front notches is more than one half of an axial width of the circular base.

* * * * *